United States Patent [19]

Weatherby

[11] Patent Number: 4,561,804

[45] **Date of Patent: * Dec. 31, 1985**

[54] EARTH RETAINING METHOD

[75] Inventor: David E. Weatherby, Rockville, Md.

[73] Assignee: Schnabel Foundation Company, Bethesda, Md.

[ * ] Notice: The portion of the term of this patent subsequent to Jan. 18, 2000 has been disclaimed.

[21] Appl. No.: 457,946

[22] Filed: Jan. 14, 1983

Related U.S. Application Data

[63] Continuation-in-part of Ser. No. 192,695, Oct. 1, 1980, Pat. No. 4,369,004.

[51] Int. Cl.[4] ..... E02D 29/02

[52] U.S. Cl. ..... 405/262; 405/287

[58] Field of Search ..... 405/262, 272, 281, 284, 405/285, 286, 287

[56] References Cited

U.S. PATENT DOCUMENTS

| | | | |
|---|---|---|---|
| 1,739,108 | 12/1929 | Weber | 405/262 |
| 1,747,038 | 2/1930 | Weber | 405/262 |
| 1,761,614 | 6/1930 | Collier | 405/285 |
| 1,933,483 | 10/1933 | Pennoyer | 405/285 |
| 2,000,492 | 5/1935 | McKeen | 405/262 |
| 2,045,112 | 6/1936 | Upson | 405/262 |
| 2,110,253 | 3/1938 | zur Nedden | 405/259 |
| 3,250,075 | 5/1966 | Webb | 405/262 |
| 3,381,479 | 5/1968 | Curzio | 405/150 |
| 3,412,562 | 11/1968 | Doughty | 405/267 |
| 3,438,207 | 4/1969 | Turzillo | 405/287 |
| 3,490,242 | 1/1970 | Schnabel | 405/262 |
| 3,555,830 | 1/1971 | York | 405/285 |
| 3,638,435 | 2/1972 | Mason | 405/262 |
| 3,802,204 | 4/1974 | Mason | 405/262 |
| 3,999,392 | 12/1976 | Fukushima | 405/281 |
| 4,055,927 | 11/1977 | Tamaro | 405/287 X |
| 4,369,004 | 1/1983 | Weatherby | 405/262 |
| 4,391,557 | 7/1983 | Hilfiker et al. | 405/287 |

FOREIGN PATENT DOCUMENTS 2233857 1/1975 France .

*Primary Examiner*—David H. Corbin

*Attorney, Agent, or Firm*—Banner, Birch, McKie & Beckett

[57] ABSTRACT

A tied back retaining wall structure is disclosed comprising channel-shaped sheet piles, a reinforcing bar matrix and a concrete wall encasing the matrix and filling the channels of the piles. The reinforcing bar matrix comprises an array of laterally disposed reinforcing bars which span the spaces between the piles. Headed studs welded to the piles insure a secure connection of the wall to the piles. A method of constructing such a wall is disclosed which comprises excavating downwardly in stages after installing sheet piling in the ground, erecting a reinforcing bar matrix and pouring or spraying concrete over the structure to form the finished wall.

16 Claims, 12 Drawing Figures

EARTH RETAINING METHOD

CROSS-REFERENCES TO RELATED APPLICATIONS

This application is a continuation-in-part of application Ser. No. 192,695, filed Oct. 1, 1980, now U.S. Pat. No. 4,369,004, issued Jan. 18, 1983.

BACKGROUND OF THE INVENTION

1. Field of the Invention

The present invention relates generally to the field of earth retaining structures and, more particularly, to a retaining wall structure and a method of constructing the same.

2. Description of the Prior Art

Tied back retaining walls for retaining an earthen mass typically incorporate wall sections of reinforced concrete, precast concrete members, a combination of steel piles and precast members, or steel piles and cast-in-place concrete. The steel piles used in these types of structures are commonly known as "soldier beams" or "soldier piles", and they are normally H or I-shaped in cross-section. Such structures and the methods for their erection are exemplified in Webb U.S. Pat. No. 3,250,075, which discloses a method and structure utilizing solider beams and cast-in-place concrete.

There are several disadvantages inherent in the use of H or I-shaped soldier beams for these types of structures. The connections between the tiebacks and the soldier beams are often complex. In addition, where reinforcing rods are to be embedded in a cast-in-place concrete wall, their connections with the soldier beams are often complex and costly.

SUMMARY OF THE INVENTION

Accordingly, it is an object of the present invention to obviate the above-noted disadvantages of the prior art by providing a method of constructing a retaining wall which is simple and economical to perform.

Another object of the invention is to provide a retaining wall which incorporates preferred sheet pile soldier beams in a tied back, cast-in-place concrete wall structure.

Another object of the invention is to provide such a structure wherein the connections between the tiebacks and the wall are relatively simple and easily made.

Another object of the invention is to provide such a structure incorporating reinforcing bars wherein the concrete wall and embedded reinforcing bars are simply and easily connected to the sheet piles and the remainder of the wall structure.

These and other objects of the present invention are accomplished by providing a method of constructing a wall for retaining an earthen mass which involves installing a plurality of laterally spaced sheet piles in the ground along the predetermined position of the wall to be constructed. A first stage of earth is excavated adjacent to the piles and the earthen mass to a depth where the cut will stand without caving. Temporary earth retaining means is installed between the piles against the exposed face of the earthen mass. Excavation and installation of temporary retaining means continues in descending stages until a depth is reached where a row of tiebacks is required to stabilize the earthen mass. A row of tiebacks is installed and anchored in the earthen mass, and these are connected to the piles. The above excavating, temporary retaining and tieback installing steps are then repeated sequentially in descending stages and rows for the full height of the earthen mass. A matrix of reinforcing bars is then placed adjacent to the piles and the temporary earth retaining means. Finally, concrete is placed against the piles and the temporary earth retaining means to encase the reinforcing bars and form a permanent tied back wall.

Instead of forming the entire concrete wall in one step, the permanent wall may be constructed in stages. This is accomplished by a method comprising the identical steps of installing sheet piles and excavating a first stage of earth to a depth where the cut will stand without caving. At this point, however, a matrix of reinforcing bars is placed adjacent to the piles and the earthen mass, and concrete is placed against the piles and the earthen mass to encase the reinforcing bars and form a portion of the permanent wall. These excavating, reinforcement placing and concrete placing steps are then repeated sequentially in descending stages until a row of tiebacks is required, and so on until a permanent wall is completed which extends the full height of the earthen mass.

Hence, a retaining wall constructed according to the invention will comprise a plurality of laterally spaced sheet piles having a channel-shaped cross-section installed adjacent to the earthen mass retained, a plurality of tiebacks anchored in the earthen mass and connected to the piles, a reinforcing bar matrix adjacent to the retained face of the earthen mass and the piles, a wall of concrete encasing the reinforcing bar matrix and extending across the piles and the retained face of the earthen mass, and anchoring means for anchoring the concrete wall and the encased reinforcing bar matrix to the piles. The piles are installed with their convex surfaces disposed against the earthen mass, and may be made up of pairs of adjacent interlocked pile segments. The tieback heads extend through the piles and are connected thereto by standard hardware in the concave channel portions thereof, the concrete completely filling the concave channel portions and encasing the tieback heads. The anchoring means may comprise a plurality of headed studs secured to the piles and encased in the concrete.

BRIEF DESCRIPTION OF THE DRAWINGS

The novel features of the invention are set out with particularity in the appended claims, but the invention will be understood more fully and clearly from the following detailed description of preferred embodiments of the invention as set forth in the accompanying drawings, in which:

DESCRIPTION OF PREFERRED EMBODIMENTS

Figure 1:
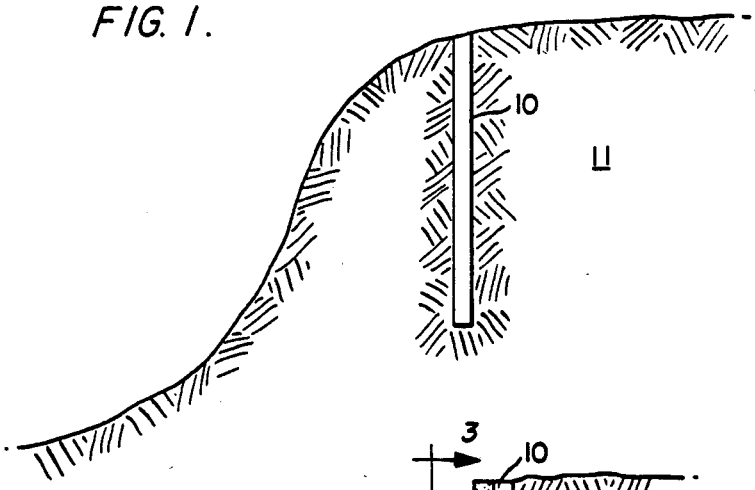
FIG. 1 is a side sectional view of an earthen mass to be retained showing one of several sheet piles in position prior to excavation.
Figure 2:
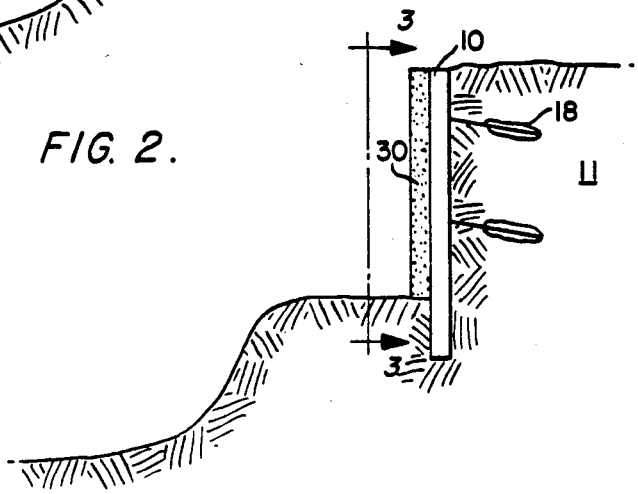
FIG. 2 is a view similar to FIG. 1 showing the completed structure.
Figure 3:
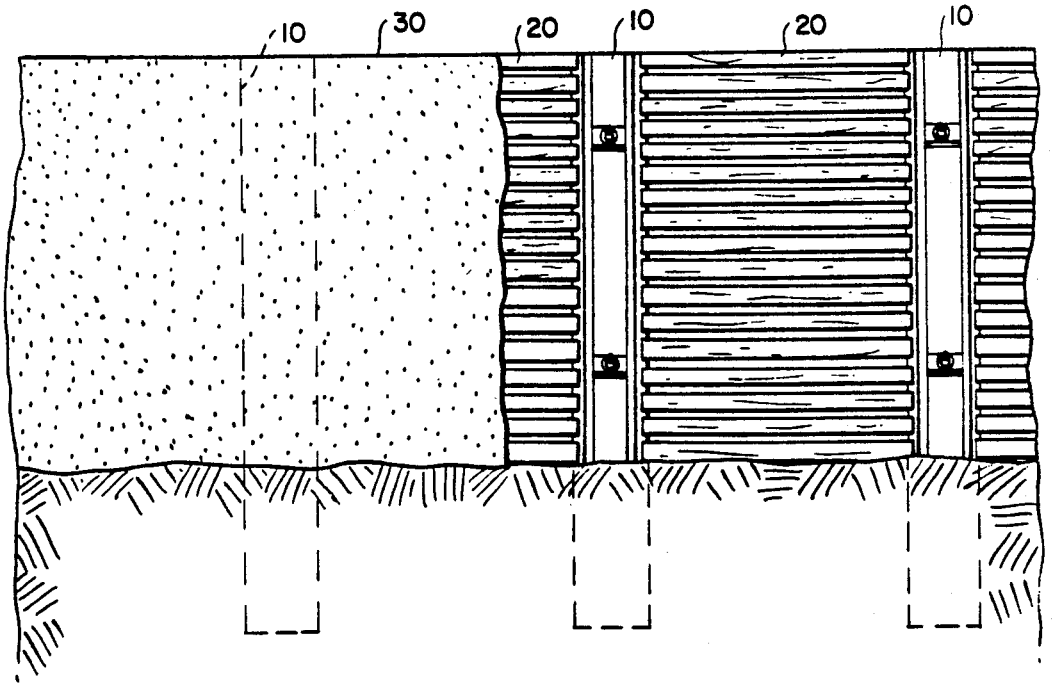
FIG. 3 is an elevational view of the wall of FIG. 2, partly in section, taken along line 3—3.
Figure 4:
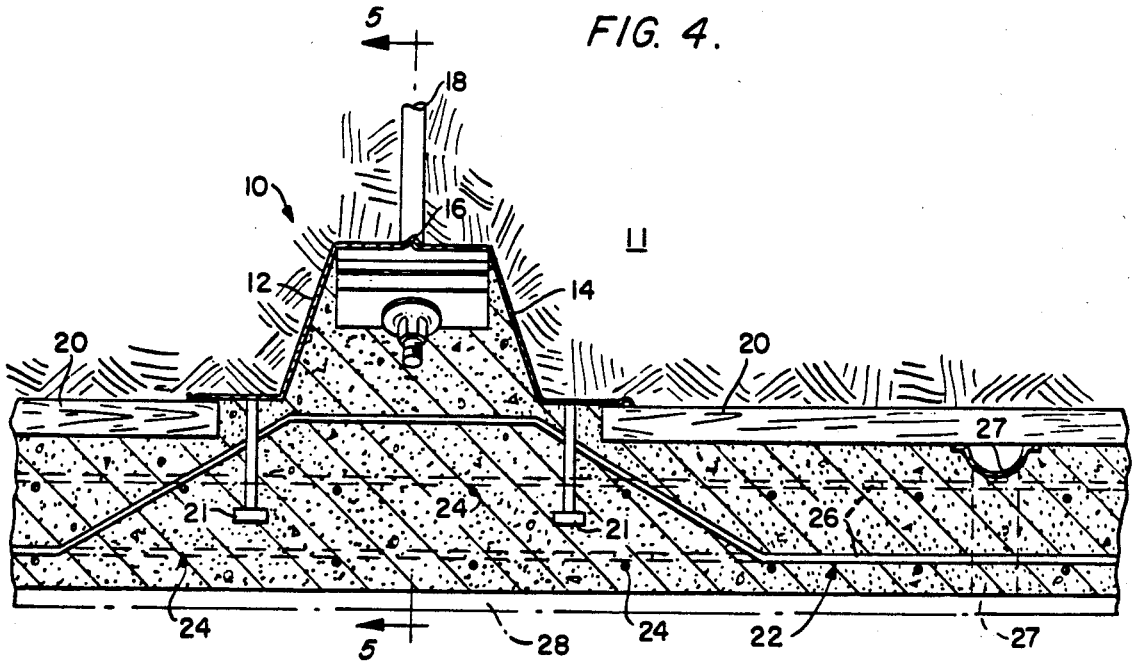
FIG. 4 is a sectional plan view of the same showing the interrelationship of a sheet pile, tieback head, reinforcing matrix and concrete wall.
Figure 5:
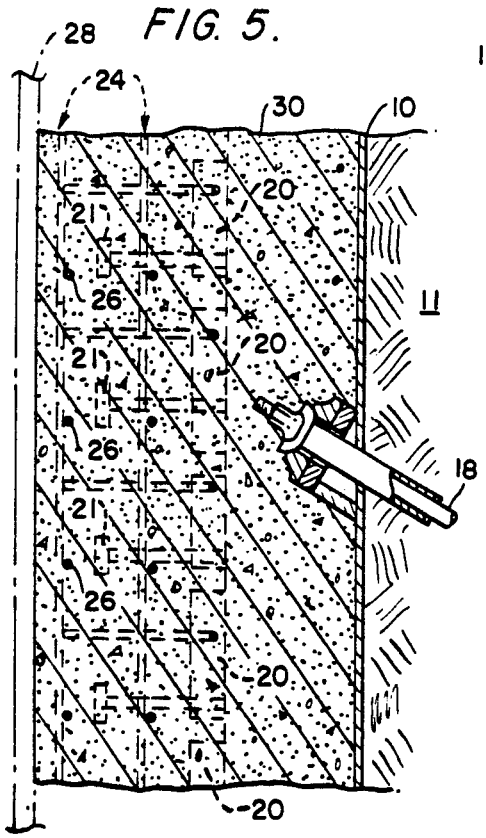
FIG. 5 is a sectional view of the same taken along line 5—5 of FIG. 4.

Referring to FIGS. 1–5, a retaining wall according to the invention is constructed by first installing a plurality of sheet piles 10 into the ground at laterally spaced locations along the future face of an earthen mass 11 to be retained. A typical spacing is 10 feet on center, but this spacing may be varied in accordance with sound engineering practices. Sheet piles 10 are channel-shaped in cross-section and may be made up of pairs of interlocking steel pile segments 12 and 14 which are joined together along seam 16. Piles 10 may be installed in the ground either vertically or on a batter in any conventional manner, such as by means of a pile driver or by being inserted into predrilled holes in the ground, and are oriented with their convex surfaces disposed against earthen mass 11. Piles 10 are installed at least as deep as the predetermined bottom of earthen mass 11. Preferably, the piles are installed below the bottom of the earthen mass so as to provide additional stability for the wall.

After the piles have been installed, excavation is commenced to a depth where the cut will stand without caving. Temporary earth retaining means are then installed between the piles against the exposed face of earthen mass 11 as needed during excavation in order to prevent the earthen mass from collapsing. Such temporary retaining means may comprise conventional timber lagging 20. Alternatively, the exposed face of the earthen mass between piles 10 may be coated with a thin layer of pneumatically applied concrete, such as gunite or shotcrete, to achieve this same object. Headed studs 21 are welded to the flanges of piles 10. The purpose of these studs is explained below.

Excavation and temporary retaining means installation continues in desceding stages until a depth is reached where a row of tiebacks is required to stabilize the earthen mass. At this point, a first row of tiebacks 18 is installed and anchored in the earthen mass. Any type of tieback may be used, but a tieback of the corrosion protected type is preferred for long lasting strength and integrity. One such type of tieback is disclosed in Weatherby U.S. Pat. No. 4,124,983. The tie rods of the tiebacks extend through the sheet piles, and are connected thereto with standard hardware, such as that described in Schnabel U.S. Pat. No. 3,490,242.

These excavating, temporary retaining and tieback installing steps are repeated sequentially in descending stages and tieback rows for the full height of earthen mass 11. When the bottom of the earthen mass has been reached, a matrix of reinforcing bars 22 is placed adjacent to piles 10 and earthen mass 11. Matrix 22 comprises an array of laterally disposed reinforcing bars 26 spanning the spaces between piles 10, and vertically disposed reinforcing bars 24. Bars 26 are angled back in the vicinity of piles 10 to pass behind the heads of studs 21. Drainage means, for example conventional drainage pipes 27 may be placed at this time. Drainage also could be placed at each stage of temporary retaining means installation.

Figure 6:
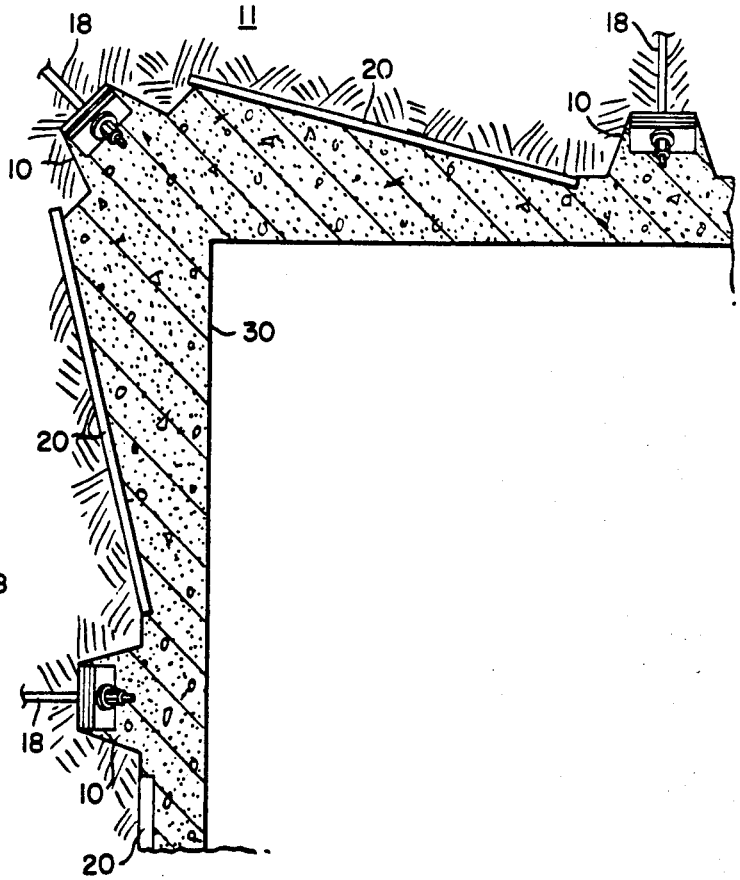
FIG. 6 is a plan view of a corner section of a sloped or battered wall constructed according to the invention.

After the reinforcing bar matrix has been placed, wall forms 28 are erected adjacent to the matrix and concrete 30 is poured between forms 28 and piles 10 and lagging 20 to completely encase reinforcing bar matrix 22, headed studs 21 and the tieback heads, and form the finished, permanent wall. After the concrete has set the forms may be stripped away. Headed studs 21 securely anchor the concrete and its encased reinforcing bar matrix 22 to piles 10. A corner section of a sloped or battered wall constructed according to the invention is illustrated in FIG. 6.

The deep-dish sheet pile sections, filled with concrete, enable the tieback anchorage to be encased in concrete for corrosion protection without increasing the thickness of the wall. Lateral rigidity is enhanced by the laterally disposed reinforcing bars 26. Such a wall structure need not exceed approximately 12 inches in thickness, irrespective of the height of the wall. Compared to cantilevered retaining walls, which require the construction of a temporary retaining wall first, the retaining wall according to the invention is a permanent structure which is constructed all at once. It is therefore less expensive to construct than cantilevered retaining walls, especially high walls requiring counterforts. And the finished surface of the retaining wall according to the invention is just as smooth and uninterrupted as that of a cantilevered wall, because the tiebacks heads are totally encased in the concrete.

Instead of erecting wall forms and pouring concrete, as in the above described method, concrete can be applied pneumatically from the bottom of the earthen mass upwardly to encase the reinforcing bar matrix, the piles and the temporary earth retaining means.

Figure 7:
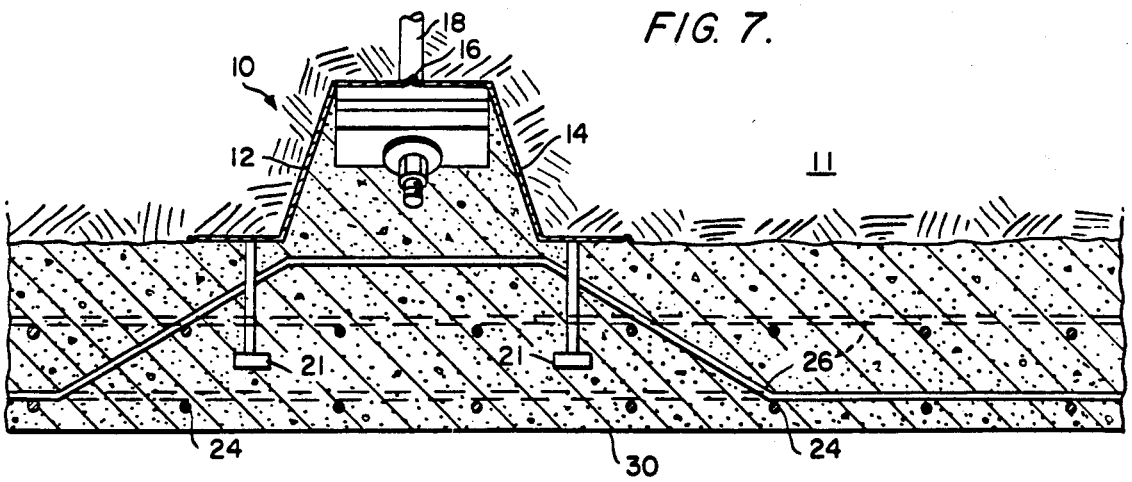
FIG. 7 is a view similar to FIG. 4 showing an alternative embodiment of the invention.
Figure 8:
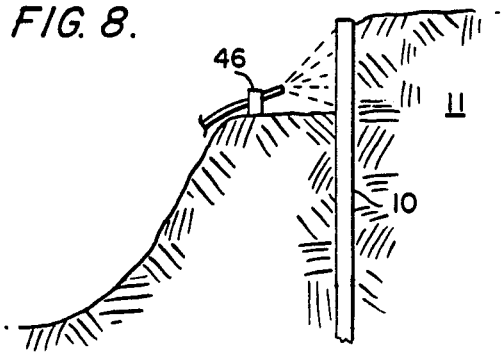
FIG. 8 is a schematic illustration showing one step in the construction of the wall illustrated in FIG. 7.
Figure 9:
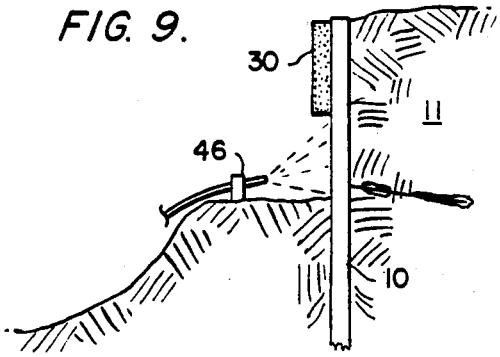
FIG. 9 is a schematic of a subsequent step in the construction of the same.

An alternative method of construction is illustrated in FIGS. 7, 8 and 9. In this method, the pile installing and first stage excavating steps of the above-described method are identical. However, a first stage matrix of reinforcing bars is placed adjacent to piles 10 and earthen mass 11 and pneumatically applied concrete, such as gunite or shotcrete, is applied by suitable equipment 46 (see FIG. 8) to completely encase the reinforcing matrix and the headed studs and form a portion of the finished, permanent tied back wall. Temporary earth retaining means, such as a thin layer of gunite, may be used if required. Of course, using this method of concrete placement, wall forms are not required. After the first stage has been completed, excavating, tieback installing in rows, reinforcing bar placing and concrete applying is performed sequentially in descending stages (see FIG. 9) for the full height of the earthen mass to complete the wall. The wall shown in FIG. 7 is constructed according to this method. If required, drainage means, for example conventional drainage pipes (not shown) may be installed in each stage before applying the concrete.

Figure 10:
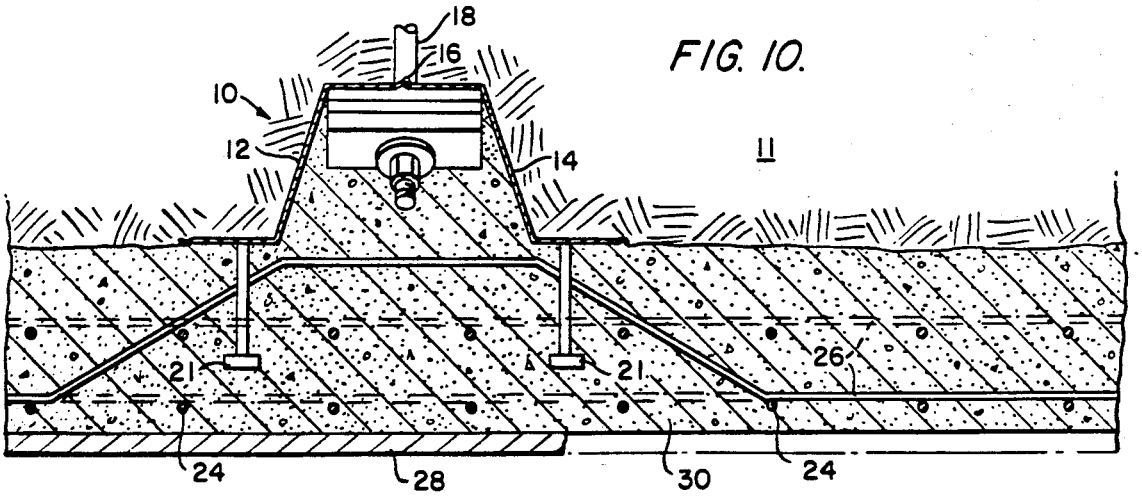
FIG. 10 is a view similar to FIG. 4 showing an alternative embodiment of the wall.
Figure 11:
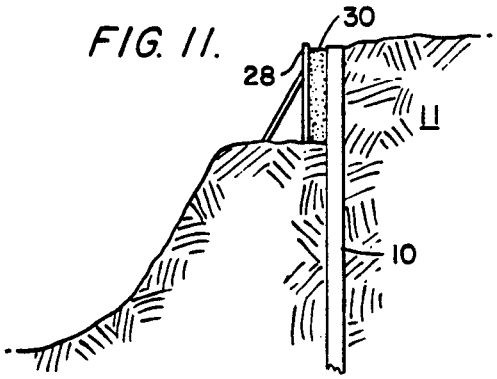
FIG. 11 is a schematic view showing one stage in the construction of the wall illustrated in FIG. 10.
Figure 12:
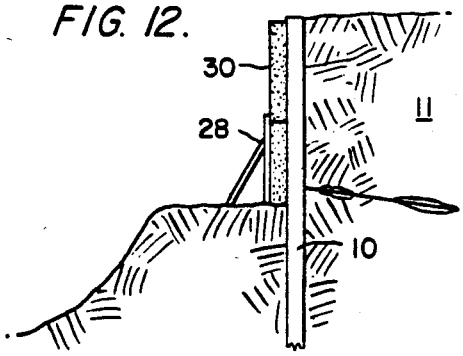
FIG. 12 is a schematic view showing a subsequent stage in the construction of the same.

Another alternative method of constructing the retaining wall according to the invention is illustrated in FIGS. 10, 11 and 12. In this method, the pile installing, first stage excavating, and reinforcing bar matrix placing steps are identical to those of the above method. At this stage, however, wall forms 28 are erected and concrete is poured to form a portion of the finished, permanent tied back wall (see FIG. 11). Excavating, reinforcement placing, form erecting and concrete pouring and tieback installing in rows are repeated sequentially in descending stages (see FIG. 12) for the full height of the earthen mass to complete the wall. If drainage means is required, these may be installed in each stage before erecting the wall forms.

Although the present invention has been illustrated in terms of a preferred embodiment, it will be obvious to one of ordinary skill that numerous modifications may be made without departing from the true spirit and scope of the invention which is to be limited only by the appended claims.

I claim:

1. A method of constructing a wall for retaining an earthen mass comprising the steps of:

installing a plurality of laterally spaced sheet piles in the ground along the predetermined position of the wall to be constructed;

excavating a first stage of earth adjacent said piles and said earthen mass to a depth where the cut will stand without caving;

installing temporary earth retaining means between said piles against the exposed face of said earthen mass;

repeating said excavating and temporary retaining steps sequentially in descending stages until a depth is reached where a row of tiebacks is required to stabilize the earthen mass;

installing and anchoring a row of tiebacks in said earthen mass and connecting said tiebacks to said piles;

repeating said excavating and temporary retaining steps sequentially in descending stages, and repeating said tieback installing, anchoring and connecting steps for sequentially descending rows for the full height of said earthen mass;

placing a matrix of reinforcing bars adjacent said piles and said temporary earth retaining means and connecting said matrix to said piles; and placing concrete against said piles and said temporary earth retaining means to encase said reinforcing bar matrix and form a permanent tied back wall.

2. A method according to claim 1 wherein said concrete placing step comprises erecting wall forms adjacent said reinforcing bars, and pouring concrete between said forms and said piles and said temporary earth retaining means.

3. A method according to claim 2 wherein said temporary earth retaining means comprises lagging.

4. A method according to claim 2 wherein said temporary earth retaining means comprises pneumatically applied concrete.

5. A method according to claim 1 wherein each of said piles has a deep channel extending along substantially the full length thereof with the open side of the channel facing away from the earthen mass.

6. A method according to claim 5 wherein said piles comprise pairs of adjacent interlocked pile segments which together form said channels.

7. A method according to claim 5 wherein the heads of said tiebacks extend through said piles into said channels, the concrete completely filling said channels and encasing said tieback heads.

8. A method according to claim 1 wherein said concrete placing step comprises pneumatically applying concrete to said matrix, said piles and said temporary earth retaining means.

9. A method according to claim 8 wherein said temporary earth retaining means comprises lagging.

10. A method according to claim 8 wherein said temporary earth retaining means comprises pneumatically applied concrete.

11. A method of constructing a wall for retaining an earthen mass comprising the steps of:

installing a plurality of laterally spaced sheet piles in the ground along the predetermined position of the wall to be constructed;

excavating a first stage of earth adjacent said piles and said earthen mass to a depth where the cut will stand without caving;

placing a matrix of reinforcing bars adjacent said piles and said earthen mass and connecting said matrix to said piles;

placing concrete against said piles and said earthen mass to encase said reinforcing bar matrix and form a segment of a permanent wall;

repeating said excavating, matrix placing and connecting, and concrete placing steps sequentially in descending stages until a depth is reached where a row of tiebacks is required to stabilize the earthen mass;

installing and anchoring a row of tiebacks in said earthen mass and connecting said tiebacks to said piles;

repeating said excavating, matrix placing and connecting, and concrete placing steps sequentially in descending stages, and repeating said tieback installing, anchoring and connecting steps for sequentially descending rows for the full height of said earthen mass to fully form a permanent tied back wall.

12. A method according to claim 11 wherein said concrete placing step comprises erecting wall forms adjacent said reinforcing bars, and pouring concrete between said forms and said piles and said earthen mass.

13. A method according to claim 11 wherein said concrete placing step comprises pneumatically applying concrete to said matrix, said piles and said earthen mass.

14. A method according to claim 11 wherein each of said piles has a deep channel extending along substantially the full length thereof with the open side of the channel facing away from the earthen mass.

15. A method according to claim 14 wherein said piles comprise pairs of adjacent interlocked pile segments which together form said channels.

16. A method according to claim 14 wherein the heads of said tiebacks extend through said piles into said channels, the concrete completely filling said channels and encasing said tieback heads.

* * * * *